US011618230B2

(12) United States Patent
Kohno et al.

(10) Patent No.: US 11,618,230 B2
(45) Date of Patent: Apr. 4, 2023

(54) PRESS MACHINE

(71) Applicant: AIDA ENGINEERING, LTD., Kanagawa (JP)

(72) Inventors: Yasuyuki Kohno, Kanagawa (JP); Ryosho Iwamura, Kanagawa (JP)

(73) Assignee: AIDA ENGINEERING. LTD., Kanagawa (JP)

( * ) Notice: Subject to any disclaimer, the term of this patent is extended or adjusted under 35 U.S.C. 154(b) by 106 days.

(21) Appl. No.: 16/931,250

(22) Filed: Jul. 16, 2020

(65) Prior Publication Data

US 2021/0060887 A1 Mar. 4, 2021

(30) Foreign Application Priority Data

Sep. 2, 2019 (JP) ..... JP2019-159557

(51) Int. Cl.
*B30B 1/00* (2006.01)
*B30B 15/00* (2006.01)
*B30B 15/16* (2006.01)

(52) U.S. Cl.
CPC ..... *B30B 1/007* (2013.01); *B30B 15/0052* (2013.01); *B30B 15/166* (2013.01)

(58) Field of Classification Search
CPC .... B30B 1/007; B30B 15/0052; B30B 15/166
USPC ..... 100/269.01
See application file for complete search history.

(56) References Cited

U.S. PATENT DOCUMENTS 6,085,520 A * 7/2000 Kohno ..... B30B 15/14 60/446
6,379,119 B1 4/2002 Truninger
10,286,442 B2 * 5/2019 Takao ..... B21D 45/04
(Continued)

FOREIGN PATENT DOCUMENTS

EP 1213132 A2 6/2002
EP 1837169 A1 9/2007
(Continued)

OTHER PUBLICATIONS

Extended European Search Report issued in corresponding European Patent Application No. 20180217, dated Dec. 7, 2020.
(Continued)

*Primary Examiner* — Shelley M Self
*Assistant Examiner* — Smith Oberto Bapthelus
(74) *Attorney, Agent, or Firm* — McDermott Will & Emery LLP

(57) ABSTRACT

The press machine includes: a hydraulic cylinder configured to drive a slide; a plurality of hydraulic pumps/motors; a first port of each of which is connected to a first pressurizing chamber of the hydraulic cylinder; a plurality of servomotors axially connected to rotating shafts of the respective hydraulic pumps/motors respectively; a low-pressure accumulator to which second ports of the hydraulic pumps/motors are each connected; a high-pressure accumulator connected to a second pressurizing chamber of the hydraulic cylinder; and a slide position controller configured to control the servomotors so that a position of the slide matches a position corresponding to a slide position command signal based on the slide position command signal from a slide position commander and a slide position signal from a slide position detector.

20 Claims, 11 Drawing Sheets

(56) References Cited

U.S. PATENT DOCUMENTS

| | | | | |
|---|---|---|---|---|
| 2011/0226141 | A1* | 9/2011 | Kohno | B21D 24/14 100/269.01 |
| 2012/0090482 | A1 | 4/2012 | Kohno et al. | |
| 2013/0269548 | A1* | 10/2013 | Kohno | B30B 1/24 100/280 |

FOREIGN PATENT DOCUMENTS

| | | | |
|---|---|---|---|
| EP | 2377629 | A1 | 10/2011 |
| EP | 2650115 | A2 | 10/2013 |
| JP | H10-505891 | A | 6/1998 |
| JP | 10-291095 | A | 11/1998 |
| JP | 2002-178200 | A | 6/2002 |
| JP | 2013-220429 | A | 10/2013 |

OTHER PUBLICATIONS

Notice of Reasons for Refusal dated Jun. 28, 2022 in a counterpart Japanese Patent Application No. 2019-159557, with English translation.

* cited by examiner

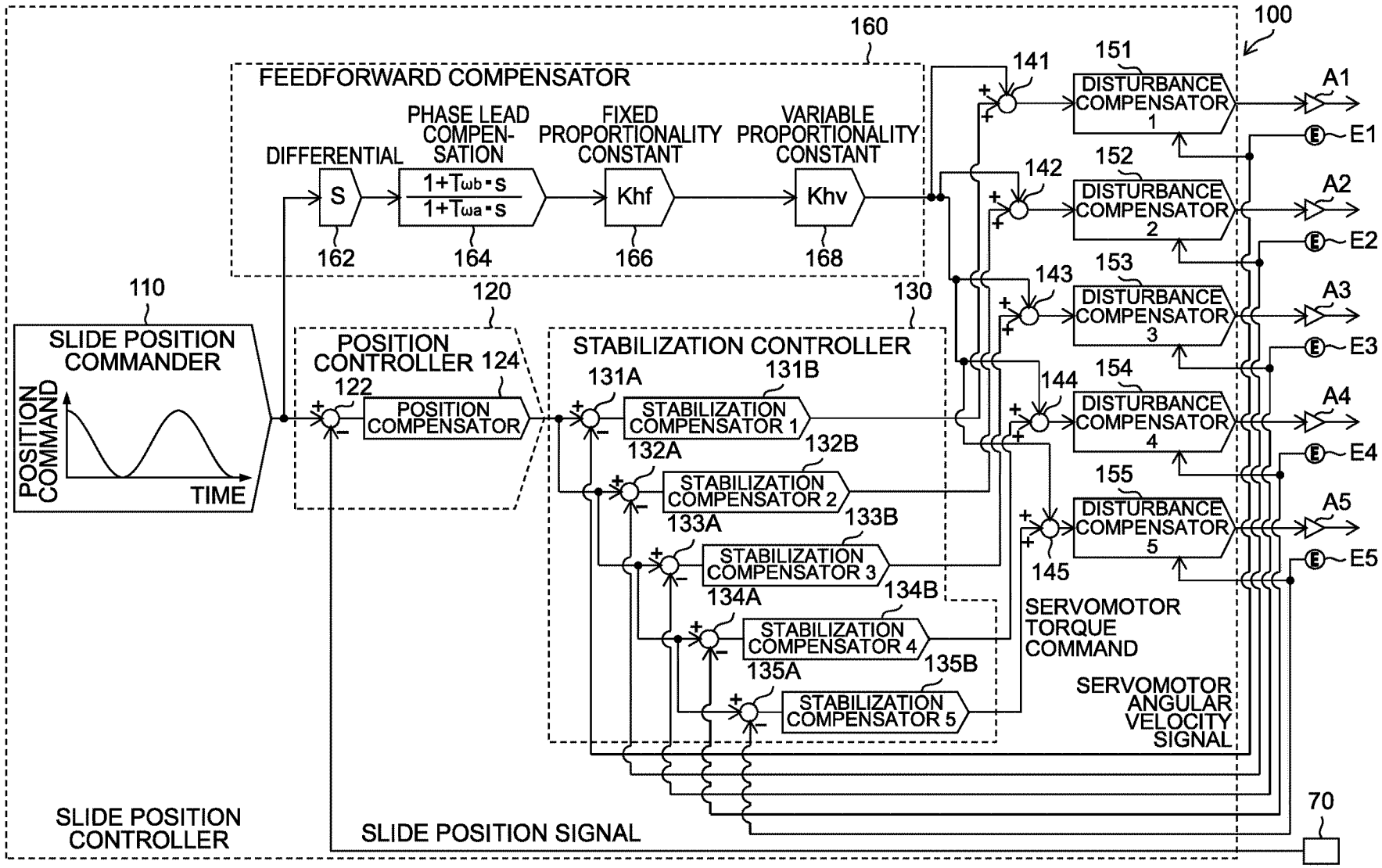
FIG.2
100
A1
A2
A3
A4
A5
E1
E2
E3
E4
E5
70
DISTURBANCE COMPENSATOR 1
DISTURBANCE COMPENSATOR 2
DISTURBANCE COMPENSATOR 3
DISTURBANCE COMPENSATOR 4
DISTURBANCE COMPENSATOR 5
151
152
153
154
155
141
142
143
144
145
SERVOMOTOR TORQUE COMMAND
SERVOMOTOR ANGULAR VELOCITY SIGNAL
160
FEEDFORWARD COMPENSATOR
DIFFERENTIAL
S
162
PHASE LEAD COMPEN-SATION
1+Tωb·s / 1+Tωa·s
164
FIXED PROPORTIONALITY CONSTANT
Khf
166
VARIABLE PROPORTIONALITY CONSTANT
Khv
168
130
STABILIZATION CONTROLLER
STABILIZATION COMPENSATOR 1
STABILIZATION COMPENSATOR 2
STABILIZATION COMPENSATOR 3
STABILIZATION COMPENSATOR 4
STABILIZATION COMPENSATOR 5
131A
131B
132A
132B
133A
133B
134A
134B
135A
135B
120
POSITION CONTROLLER 124
POSITION COMPENSATOR
122
SLIDE POSITION SIGNAL
110
SLIDE POSITION COMMANDER
POSITION COMMAND
TIME
SLIDE POSITION CONTROLLER

PRESS MACHINE

CROSS-REFERENCE TO RELATED APPLICATIONS

The present application claims priority under 35 U.S.C. § 119 to Japanese Patent Application No. 2019-159557, filed on Sep. 2, 2019. The above application is hereby expressly incorporated by reference, in its entirety, into the present application.

BACKGROUND OF THE INVENTION

Field of the Invention

The present invention relates to a press machine, and particularly to a high-speed press machine in which the number of strokes per minute (Shots Per Minute: SPM) of a slide is equal to or more than 100.

Description of the Related Art

In the related art, in a case where precision mass components having a relatively thin profile, such as a lead frame and precision terminals of an integrated circuit (IC), are produced at a relatively high SPM of about 100 to 500 SPM, a mechanical press machine specialized almost for high speed operations has been employed.

This type of press machine is configured to include many special mechanisms for maintaining a high SPM, such as a dynamic balance retaining mechanism for suppressing a runout of the press machine due to an unbalanced inertia force generated by a crankshaft or the like, and a special bearing mechanism for maintaining an even local minimum gap between the crankshaft and crankshaft bearings due to a rotation angle under high-speed rotation. This increases the cost correspondingly. In addition, it has been difficult to change a stroke amount of the slide according to (the height of) the produce due to the complexity of the mechanism.

On the other hand, Japanese Translation of PCT International Application Publication No. 1110-505891 and Japanese Patent Laid-Open No. 2002-178200 each describe a liquid pressure drive device and a high-speed press machine each including a hydraulic cylinder.

In a liquid pressure drive device described in Japanese Translation of PCT International Application Publication No. H10-505891, one of ports of a hydraulic pump driven by a servomotor is connected to one pressure chamber of the hydraulic cylinder, the other port of the hydraulic pump is connected to a tank, and an accumulator is connected to the other pressure chamber of the hydraulic cylinder. The liquid pressure drive device is capable of a 4-quadrant operation by the servomotor and the accumulator.

In a high-speed press machine disclosed in Japanese Patent Laid-Open No. 2002-178200, a ram of a press cylinder is connected to a rod of small-diameter auxiliary cylinder. In a case where no load is applied to the press cylinder, the ram is advanced and retracted at high speed by the auxiliary cylinder. In a case where the ram of the press cylinder starts a pressurizing operation, a pressurizing chamber of the press cylinder and a pressurizing chamber of the auxiliary cylinder are communicated with each other to perform pressurization at a low speed and with a large thrust force. Note that one port and the other port of a pump which can discharge a working fluid in two directions are respectively connected to the pressurizing chamber on one side of the auxiliary cylinder and the pressurizing chamber on the other side, and a servomotor which can rotate in forward and reverse directions is connected to a rotating shaft of the pump.

CITATION LIST

Patent Literature 1: Japanese Translation of PCT International Application Publication No. H10-505891

Patent Literature 2: Japanese Patent Laid-Open No. 2002-178200

SUMMARY OF THE INVENTION

In contrast to a mechanical press machine, because a hydraulic press machine using a hydraulic cylinder is a direct acting type in which no load acts to press the press machine in a lateral direction, an amount of runout of a slide is small and thus the hydraulic press machine is suitable for precise forming. However, the hydraulic press machine is weak in high SPM operation.

Japanese Translation of PCT International Application Publication No. H10-505891, describes that the hydraulic cylinder is controlled by the hydraulic pump driven by a servomotor. However, there is no description about control of the position of the slide at a high SPM. In addition, the liquid pressure drive device described in Japanese Translation of PCT International Application Publication No. H10-505891 has a single hydraulic pump driven by a servomotor, and it is not practical to operate the hydraulic cylinder at a high SPM by the single hydraulic pump.

In the high-speed press machine described in Japanese Patent Laid-Open No. 2002-178200, the rod of the small-diameter auxiliary cylinder is connected to the ram of the press cylinder, and when no load is applied to the press cylinder, the ram is advanced and retracted by the auxiliary cylinder at high speed. In a case where the rod of the small-diameter auxiliary cylinder is connected to the ram having a large mass, the ram cannot be advanced and retracted at high speed by the small-diameter auxiliary cylinder driven by the single pump. In addition, in the high-speed press machine disclosed in Japanese Patent Laid-Open No. 2002-178200, the ram is advanced and retracted at high speed when no load is applied to the press cylinder. In a case where the ram of the press cylinder starts the pressurizing operation, the operation of the ram is changed to low speed operation (and large thrust force).

In view of such circumstances, the present invention aims to provide a press machine which can reduce an amount of runout of a slide during a high SPM operation, with reduced cost.

In order to achieve the above-described object, a press machine according to one mode of the present invention includes: a hydraulic cylinder configured to drive a slide; a plurality of hydraulic pumps/motors configured to rotate in forward and reverse directions so as to supply a working fluid to the hydraulic cylinder or suck the working fluid from the hydraulic cylinder, the plurality of hydraulic pumps/motors each including a first port connected to a first pressurizing chamber of the hydraulic cylinder that drives the slide in a forward direction; a plurality of servomotors axially connected to rotating shafts of the plurality of hydraulic pumps/motors respectively, a first pressure source having a constant pressure equal to or higher than 0.3 MPa and connected to each of second ports of the plurality of hydraulic pumps/motors; a second pressure source having a constant pressure equal to or higher than 1 MPa and connected to a second pressurizing chamber of the hydraulic cylinder that drives the slide in a reverse direction; a slide position commander configured to output a slide position command signal for the slide; a slide position detector configured to detect the position of the slide and output a slide position signal; and a slide position controller configured to control the plurality of servomotors so that the position of the slide matches a position corresponding to the slide position command signal based on the slide position command signal and the slide position signal.

According to the one mode of the present invention, the first ports of the plurality of hydraulic pumps/motors axially connected respectively to the plurality of servomotors are each connected (connected in parallel) to the first pressurizing chamber of the hydraulic cylinder so as to enable the high SPM operation and adjustment (increase/decrease) of the pressurizing capacity of the press machine. Further, it is possible to reduce the moments of inertia of the rotating bodies linked to the rotating shafts of respective servomotors and the rotating shafts thereof, and enhance angular velocity responsiveness of the rotating shafts of the hydraulic pumps/motors+the servomotors. In addition, it is possible to reduce a drive torque for accelerating the rotating shafts of the servomotors and the rotating bodies linked to the rotating shafts thereof, so that the drive torque generated by the servomotors can be used effectively for generating a press load.

Further, since the pressures of the first pressure source and the second pressure source are always ensured to be equal to or more than 0.3 MPa when the hydraulic pumps/motors rotate in the forward and reverse directions, the hydraulic pumps/motors function stably without being accompanied by cavitation (working fluid suction failure), and the first pressurizing chamber and the second pressurizing chamber of the hydraulic cylinder are constantly filled with the working fluid, and a gap which may be generated in the mechanical press machine is zero during operation.

Furthermore, it is possible to construct the press machine which drives the slide by the hydraulic cylinder and can perform a high-speed press at low cost in association with a simple structure. In addition, the press machine can vary the stroke amount depending on a height of the product. In addition, because the press machine is a direct-acting type, no load acts to push the press machine in the lateral direction. Therefore, an amount of runout of the slide is small during the high SPM operation, and thus the press machine is suitable for precise forming.

Further, when the slide position is controlled to make the slide position follow the slide position command signal, the slide position signal follows the slide position command signal substantially linearly. This tendency is also seen in a slide position command signal that drives the slide at a high SPM.

In the press machine according to another mode of the present invention, it is preferable that moments of inertia of the rotating shafts of respective servomotors of the plurality of servomotors and the rotating bodies linked to the rotating shafts thereof are each equal to or less than 1 $kgm^2$. By suppressing the moment of inertia to be equal to or less than 1 $kgm^2$, it is possible to enhance angular velocity responsiveness of the rotating shafts of the hydraulic pumps/motors+the servomotors. In addition, it is possible to reduce a drive torque for accelerating the rotating shafts of the servomotors and the rotating bodies linked to the rotating shafts thereof, and thus the drive torque generated by the servomotors can be used effectively for generating a press load correspondingly.

In the press machine according to still another mode of the present invention, it is preferable that the slide position command signal output from the slide position commander has a smooth continuous time differential signal thereof. Since the time differential signal of the slide position command signal continues smoothly, a phase lead compensation can act effectively on the time differential signal.

In the press machine according to still another mode of the present invention, it is preferable that the slide position command signal output from the slide position commander changes to form a sinusoidal curve or a crank curve with respect to the elapsed time. Here, the slide position command signal which changes to form the crank curve corresponds to a slide position command signal in a case where the slide is driven by a crank mechanism.

In the press machine according to still another mode of the present invention, it is preferable that the slide position commander outputs the slide position command signal which makes the number of strokes per minute of the slide to be equal to or more than 100. This makes it possible to achieve the high SPM operation of the slide.

In the press machine according to still another mode of the present invention, it is preferable that the slide position commander outputs the slide position command signal which makes the stroke amount from a top dead center to a bottom dead center of the slide to be equal to or less than 50 mm. With a stroke amount equal to or less than 50 mm, the high SPM effect can be effectively exhibited. The reason is that, in the case of a stroke amount of that degree, the SPM does not depend on the maximum slide speed (at which the liquid pressure drive is not relatively good) but depends on the responsiveness of the slide speed.

In the press machine according to still another mode of the present invention, it is preferable that the press machine includes a plurality of angular velocity detectors each configured to detect rotational angular velocities of the plurality of servomotors, and the slide position controller includes a stabilization controller that uses angular velocity signals each detected by the plurality of angular velocity detectors as angular velocity feedback signals. The stabilization controller serves to improve a phase delay of a loop transfer function (open loop) of the slide position control system from the slide position command signal to the slide position signal and stabilize the position control function.

In the press machine according to still another mode of the present invention, it is preferable that the slide position controller includes a feedforward compensator that receives the slide position command signal as an input signal, and causes a feedforward compensation amount calculated by the feedforward compensator to act on torque command signals of the plurality of servomotors calculated based on the slide position command signal and the slide position signal. The feedforward compensator compensates for a phase delay amount of a slide speed signal with respect to a slide speed command signal (a signal indicating the differential of the slide position command signal).

In the press machine according to still another mode of the present invention, it is preferable that the feedforward compensator calculates the feedforward compensation amount by a phase lead compensation element.

In the press machine according to still another mode of the present invention, the phase lead compensation element is represented by $(1+T_{\omega b}\cdot s)/(1+T_{\omega a}\cdot s)$, where s is a Laplace operator, $T_{\omega a}$ and $T_{\omega b}$ are each constants, and the constants $T_{\omega a}$ and $T_{\omega b}$ are set in accordance with the number of strokes per minute of the slide and the stroke amount from the top dead center to the bottom dead center of the slide. The phase lead compensation element compensates for an action of changing the phase from the slide position command signal to the slide position signal (phase delay) as the slide position control system (closed loop) goes toward the high SPM. It is preferable that the constants $T_{\omega a}$ and $T_{\omega b}$ of the phase lead compensation element are set in accordance with the number of strokes and the stroke amount of the slide.

In the press machine according to still another mode of the present invention, it is preferable that the feedforward compensator calculates the feedforward compensation amount by a differential element and a proportional element. The differential element and the proportional element compensate for the phase delay and a change in a gain from the slide position command signal to the slide position signal.

In the press machine according to still another mode of the present invention, it is preferable that a plurality of hydraulic cylinders for driving the slide are arranged in parallel, and the plurality of hydraulic pumps/motors and the plurality of servomotors are provided for the respective hydraulic cylinders. Accordingly, even though the slide has a large size and mass, the high SPM operation can be achieved while maintaining the slide horizontally.

According to the present invention, because the press machine is a direct-acting type which drives the slide by the cylinder, an amount of runout of the slide is small during the high SPM operation, and thus the press machine is suitable for precise press forming. Further, an inexpensive press machine is achieved as compared to a mechanical high-speed press machine, and furthermore the stroke amount can be varied easily according to the heights of products.

BRIEF DESCRIPTION OF THE DRAWINGS

FIG. 2 is a block diagram illustrating a detailed configuration of a slide position controller illustrated in FIG. 1;

DETAILED DESCRIPTION OF THE PREFERRED EMBODIMENTS

Hereinafter, preferred embodiments of a press machine according to the present invention will now be described in detail with reference to the accompanying drawings.

[First Embodiment]

Figure 1:
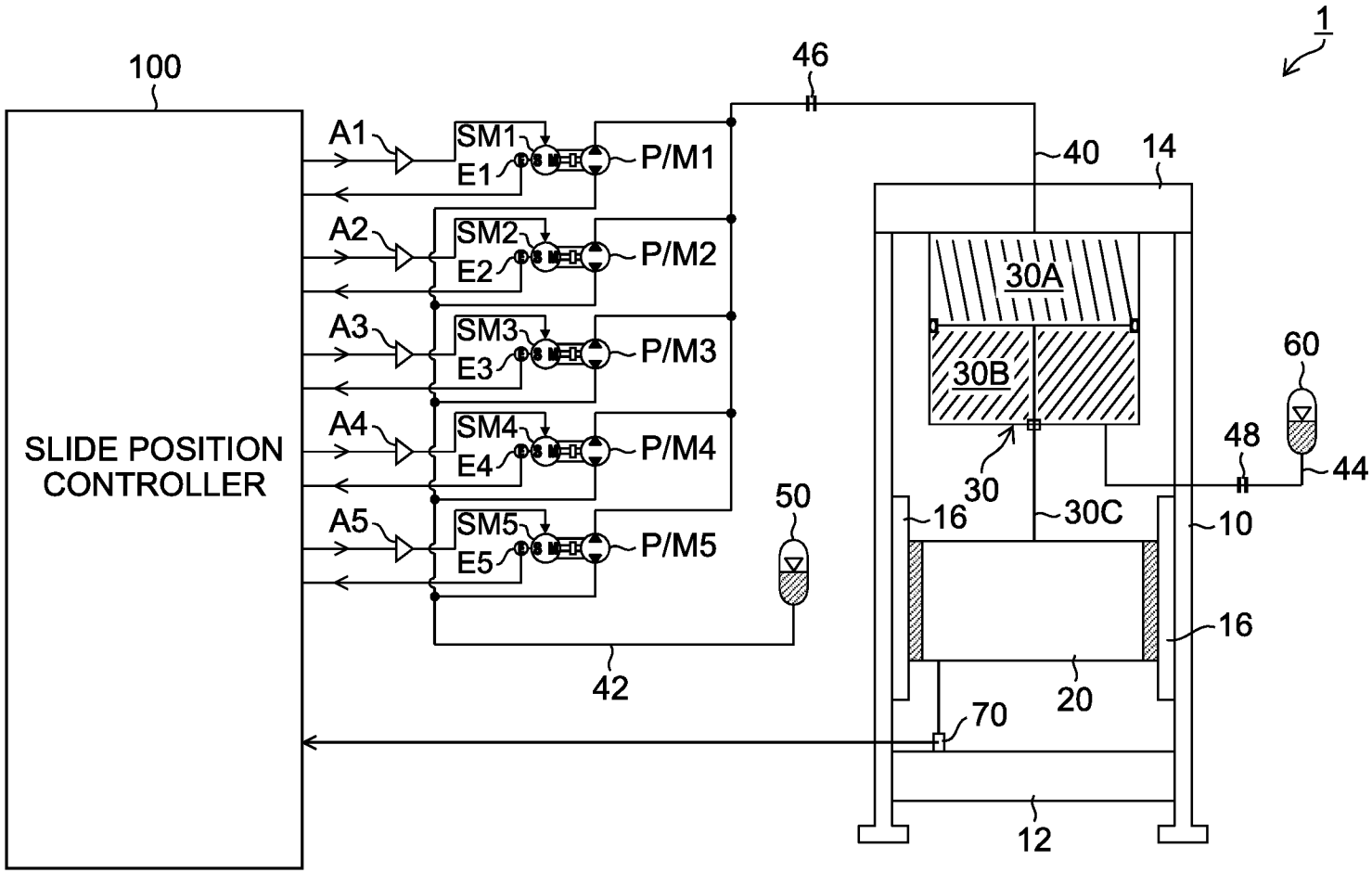
FIG. 1 is a drawing illustrating a first embodiment of a press machine according to the present invention.

FIG. 1 is a drawing illustrating a first embodiment of a press machine according to the present invention.

In the press machine 1 according to the first embodiment illustrated in FIG. 1, a frame includes a column 10, a bed 12, and a crown (frame upper reinforcing member) 14, and a slide 20 is guided by a guide member 16 provided in the column 10 so as to be movable in a vertical direction (perpendicular direction).

A hydraulic cylinder 30 configured to drive the slide 20 is fixed to the crown 14, and a piston rod 30C of the hydraulic cylinder 30 is coupled to the slide 20.

A plurality of hydraulic pumps/motors (in the first embodiment, five hydraulic pumps/motors (P/M1 to P/M5)) are provided as hydraulic devices for driving the hydraulic cylinder 30. A plurality of servomotors (in the first embodiment, five servomotors (SM1 to SM5)) are axially connected to the rotating shafts of the hydraulic pumps/motors (P/M1 to P/M5), respectively.

One of ports (first port) of each of the five hydraulic pumps/motors (P/M1 to P/M5) is connected to one of pressurizing chambers (first pressurizing chamber) 30A of the hydraulic cylinder 30 through a pipe 40, and the other port (second port) of each of the five hydraulic pumps/ motors (P/M1 to P/M5) is connected to a first pressure source (hereinafter referred to as "low-pressure accumulator") 50 having a constant pressure (substantially constant pressure) equal to or more than 0.3 MPa through a pipe 42.

A second pressure source (hereinafter referred to as "high-pressure accumulator") 60 having a constant pressure (substantially constant pressure) equal to or more than 1 MPa is connected to the other pressurizing chamber (second pressurizing chamber) 30B of the hydraulic cylinder 30 through a pipe 44.

The plurality of (five) hydraulic pumps/motors (P/M1 to P/M5) are connected in parallel to the pipe 40 on the pressurizing chamber 30A side of the hydraulic cylinder 30, and the rotation shafts of the servomotors (SM1 to SM5) are axially connected to the rotation shafts of the respective hydraulic pumps/motors (P/M1 to P/M5). The reason why this configuration is adopted is: to reduce moments of inertia of the rotation shafts of the servomotors and rotating bodies linked to the rotation shafts thereof; to enhance angular velocity responsiveness of the rotation shafts of the hydraulic pumps/motors+servomotors; and to reduce drive torque for accelerating the rotating shafts of the servomotors and the rotating bodies linked to the rotation shafts thereof, thereby using the drive torque generated by the servomotors effectively for generating a press load. It is preferable that the moment of inertia of one set of hydraulic pump/motor+servomotor is equal to or less than 1 $kgm^2$.

Note that the pipe 40 on the pressurizing chamber 30A side of the hydraulic cylinder 30 and the pipe 44 on the pressurizing chamber 30B side of the hydraulic cylinder 30 are provided with switching valves (on-off valves) 46 and 48, respectively. The switching valves 46 and 48 are fully opened in a case where the press machine 1 is operated.

The pressurizing chamber 30A of the hydraulic cylinder 30 is a pressurizing chamber to which a working fluid (working oil) is supplied from each of the hydraulic pumps/motors (P/M1 to P/M5) in a case where the slide 20 is driven in the forward direction (perpendicularly downward direction). The pressurizing chamber 30B of the hydraulic cylinder 30 is a pressurizing chamber to which the working fluid is supplied from the high-pressure accumulator 60 in a case where the slide 20 is driven in the reverse direction (perpendicularly upward direction).

The servomotors (SM1 to SM5) rotate the rotating shafts of the hydraulic pumps/motors (P/M1 to P/M5) forward or reverse (rotation in the forward and reverse direction) to supply working fluid (working oil) from the respective hydraulic pumps/motors (P/M1 to P/M5) to the pressurizing chambers 30A of the hydraulic cylinders 30, or to suck the working fluid from the pressurizing chambers 30A and vary the pressure in the pressurizing chambers 30A of the hydraulic cylinder 30.

The hydraulic cylinder 30 operates to move a piston rod 30C (the slide 20) downward when a product of the pressure in the pressurizing chamber 30A and a cross-sectional area of the pressurizing chamber 30A of the hydraulic cylinder 30 becomes larger than a product of a substantially constant pressure in the pressurizing chamber 30B (high-pressure accumulator 60) of the hydraulic cylinder 30 and a cross-sectional area of the pressurizing chamber 30B. In contrast, the hydraulic cylinder 30 operates to move the piston rod 30C (the slide 20) upward when the product of the pressure in the pressurizing chamber 30A and the cross-sectional area of the pressurizing chamber 30A of the hydraulic cylinder 30 becomes smaller than a product of a substantially constant pressure in the pressurizing chamber 30B and the cross-sectional area of the pressurizing chamber 30B of the hydraulic cylinder 30.

A slide position detector 70 is installed on the bed 12. The slide position detector 70 detects the position of the slide 20 and outputs a slide position signal indicating the detected position of the slide 20 to the slide position controller 100.

The respective servomotors (SM1 to SM5) are provided with angular velocity detectors E1 to E5 configured to detect rotational angular velocities of the servomotors (SM1 to SM5), respectively. The angular velocity detectors (E1 to E5) respectively output angular velocity signals indicating detected angular velocities of the servomotors (SM1 to SM5) to the slide position controller 100.

The slide position controller 100 controls the five servomotors (SM1 to SM5) so that the position of the slide 20 takes a position corresponding to the slide position command signal based on a slide position command signal input from the slide position commander 110 (FIG. 2) and a slide position signal input from the slide position detector 70, and outputs the torque command signals of the servomotors SM1 to SM5 calculated based on the slide position command signal, the slide position signal, and the like to the amplifiers (A1 to A5) of the respective servomotors (SM1 to SM5).

<Slide Position Controller>

FIG. 2 is a block diagram illustrating a detailed configuration of the slide position controller 100 illustrated in FIG. 1.

The slide position controller 100 illustrated in FIG. 2 includes a slide position commander 110, a position controller 120, a stabilization controller 130, adders 141 to 145, disturbance compensators 151 to 155, and a feedforward compensator 160.

The slide position commander 110 outputs a sinusoidal slide position command signal calculated based on settings of the number of strokes (SPM) per minute of the slide 20 and the stroke amount from the top dead center to the bottom dead center of the slide 20, to the position controller 120.

The position controller 120 includes a subtractor 122 and a position compensator 124. The slide position command signal is added to a positive input of the subtractor 122, and the slide position signal is added to a negative input of the subtractor 122 from the slide position detector 70. The subtractor 122 calculates a deviation (position deviation) between the slide position command signal and the slide position signal, and outputs the calculated deviation to the position compensator 124 to reduce the calculated position deviation.

The position compensator 124 adds a compensation amount proportional to the integral amount of the position deviation, and the like to the compensation amount proportional to the position deviation to calculate a signal for promoting the reduction of the position deviation.

The stabilization controller 130 has five subtractors (131A to 135A) and five stabilization compensators (131B to 135B). The stabilization controller 130 serves to improve the problem that the phase delay of the loop transfer function (open loop) of the slide position control system from the slide position command signal to the slide position signal increases and the position control function becomes unstable in the press machine having the position controller 120 only.

The signal calculated by the position controller 120 is added to positive inputs of the respective subtractors (131A to 135A), and the angular velocity signals indicating the rotational angular velocities of the respective servomotors (SM1 to SM5) detected by the angular velocity detectors E1 to E5 are added as angular velocity feedback signals to negative inputs of the respective subtractors (131A to 135A). The subtractors (131A to 135A) each calculate a deviation (angular velocity deviation) between two input signals and output the calculated angular velocity deviation to the stabilization compensators (131B to 135B), respectively.

Each of the stabilization compensators (131B to 135B) adds a compensation amount proportional to the integral amount of the angular velocity deviation and the like to the compensation amount proportional to the angular velocity deviation calculated by each of the subtractors (131A to 135A), to calculate a signal for promoting the reduction of the angular velocity deviation.

The signals calculated by the respective stabilization compensators (131B to 135B) are output respectively to the adders (141 to 145) as the torque command signals of the respective servomotors (SM1 to SM5).

The feedforward compensator 160 includes a differential element 162, a phase lead compensation element 164, and proportional elements (first proportional element 166 and second proportional element 168). The feedforward compensator 160 serves to reduce the deviation between the slide position command signal and the slide position signal during operation of the slide 20.

The differential element 162 of the feedforward compensator 160 receives the slide position command signal from the slide position commander 110 and outputs a result of temporal differentiation of the slide position command signal.

The phase lead compensation element 164 is a compensation element that causes phase lead of the input signal, and the transfer function thereof is expressed by $(1+T_{\omega b}\cdot s)/(1+T_{\omega a}\cdot s)$. Note that "s" is a Laplace operator. Further, it is preferable that $T_{\omega a}$ and $T_{\omega b}$ are each constants and are suitably set in accordance with the number of strokes (SPM) of the slide 20 driven reciprocally in the vertical direction and the stroke amount of the slide 20.

The first proportional element 166 of the feedforward compensator 160 outputs a result obtained by multiplying a fixed proportionality constant (Khf). The second proportional element 168 outputs a result obtained by multiplying the variable proportionality constant (Khv).

The signal output from the feedforward compensator 160 (feedforward compensation amount) is added respectively to the other inputs of the adders (141 to 145). As described above, the torque command signals of the respective servomotors (SM1 to SM5) are each added to one of inputs of the adders (141 to 145). The adders (141 to 145) apply (add) signals from the feedforward compensator 160 to the torque command signals of the servomotors (SM1 to SM5).

Here, the differential element 162 and the first proportional element 166 of the feedforward compensator 160 compensate for the phase delay amount of the slide speed signal which is the compensation (side effect) of stabilization due to the stabilization controller 130 with respect to the slide speed command signal (which means the differential of the slide position command signal).

The phase lead compensation element 164 and the second proportional element 168 of the feedforward compensator 160 compensate for an action of changing the phase and the gain from the slide position command signal to the slide position signal (the phase is delayed and the gain is increased), as the SPM of the slide position control system (closed loop) becomes higher.

The phase lead compensation element 164 is not arranged in series with the compensation elements constituting a closed loop, such as the position controller 120 and the stabilization controller 130, but is arranged in series with the open loop feedforward compensator 160. This (the fact that the phase lead compensation element 164 is not arranged in the closed loop) avoids the slide position control system itself from amplifying the noise and becoming unstable.

The disturbance compensators (151 to 155) serve to compensate for the disturbance torque acting (from the outside) on the respective servomotors (SM1 to SM5). The respective disturbance compensators (151 to 155) compare the angular velocity signals indicating the rotational angular velocities of the servomotors (SM1 to SM5) input respectively from the angular velocity detectors (E1 to E5) with (the basic torque command) signals added by the adders (141 to 145), and calculate (as disturbance torque the amounts of discrepancy from the respective angular acceleration signals to be generated for the respective torque command signals to be emitted), thereby estimating and eliminating the disturbance.

The torque command signals calculated by the respective disturbance compensators (151 to 155) are output to the respective servomotors (SM1 to SM5) via the amplifiers (A1 to A5), respectively. Accordingly, each of the servomotors (SM1 to SM5) is driven and controlled such that the position of the slide 20 takes a position corresponding to the slide position command signal.

By causing the signal from the feedforward compensator 160 to act on the torque command signals of the respective servomotors (SM1 to SM5) as described above, it is possible to cause the slide positions (signals) to follow the high SPM slide position command signals without temporal delay with respect to the servomotor angular velocities (without phase delay).

The torque command signals passed through the disturbance compensators (151 to 155) are output to the amplifiers (A1 to A5) of the respective servomotors (SM1 to SM5). Consequently, the servomotors (SM1 to SM5) illustrated in FIG. 1 operate in synchronization with each other, and the amounts of fluid flowing in and out to/from one of the ports (drive side ports) of the respective hydraulic pumps/motors (P/M1 to P/M5) axially connected to the respective servomotors (SM1 to SM5) are summed up, and act on the pressurizing chamber 30A located on the lower side of the hydraulic cylinder 30. At this time, a substantially constant pressure equal to or higher than 0.3 MPa (in the first embodiment, about 0.5 MPa) accumulated in the low-pressure accumulator 50 acts on the other ports of the respective hydraulic pumps/motors (P/M1 to P/M5). Therefore, when the hydraulic pumps/motors (P/M1 to P/M5) rotate at a high speed with the high SPM operation, cavitation can be prevented, and the operations of the hydraulic pumps/motors (P/M1 to P/M5) can be stabilized.

Further, because a substantially constant pressure equal to or higher than 1 MPa (in the first embodiment, about 6 MPa) accumulated in the high-pressure accumulator 60 is applied to the pressurizing chamber 30B on the rising side of the hydraulic cylinder 30, the substantially constant pressure is responsible for the increase of an acceleration force of the slide 20 during the upward movement and a deceleration force of the slide 20 during the downward movement.

In this manner, the slide 20 moves upward and downward (at a high SPM) in accordance with the slide position command signal.

<Operational Example>

The press machine 1 according to the first embodiment illustrated in FIGS. 1 and 2 was manufactured based on the following physical specifications.

Number of servomotors+hydraulic pumps/motors used: 5

Output of each servomotor: 10 kW

Displacement of the hydraulic pump/motor: 40 $cm^3$/rev

Moment of inertia of a single servomotor+hydraulic pump/motor: 0.02 $kgm^2$

Constant pressure of the low-pressure accumulator 50: 0.5 MPa

Number of hydraulic cylinders 30 used: 1

Cross-sectional area of the pressurizing chamber 30A: 176 $cm^2$

Cross-sectional area of the pressurizing chamber 30B: 136 $cm^2$

Constant pressure of the high-pressure accumulator 60: 6 MPa

Mass of slide 20: 800 kg

Constant of the phase lead compensation element 164, $T_{\omega a}$=0.1 and $T_{\omega b}$=0.1 (no phase lead)

Variable proportionality constant Khv of second proportional element 168: 1

Maximum pressurization capacity: 400 kN

[Experimental Results]

The first to the sixth experimental results in a case where the press machine 1 having the physical specifications described above is operated under various conditions are illustrated.

<First Experimental Result>

Figure 3:
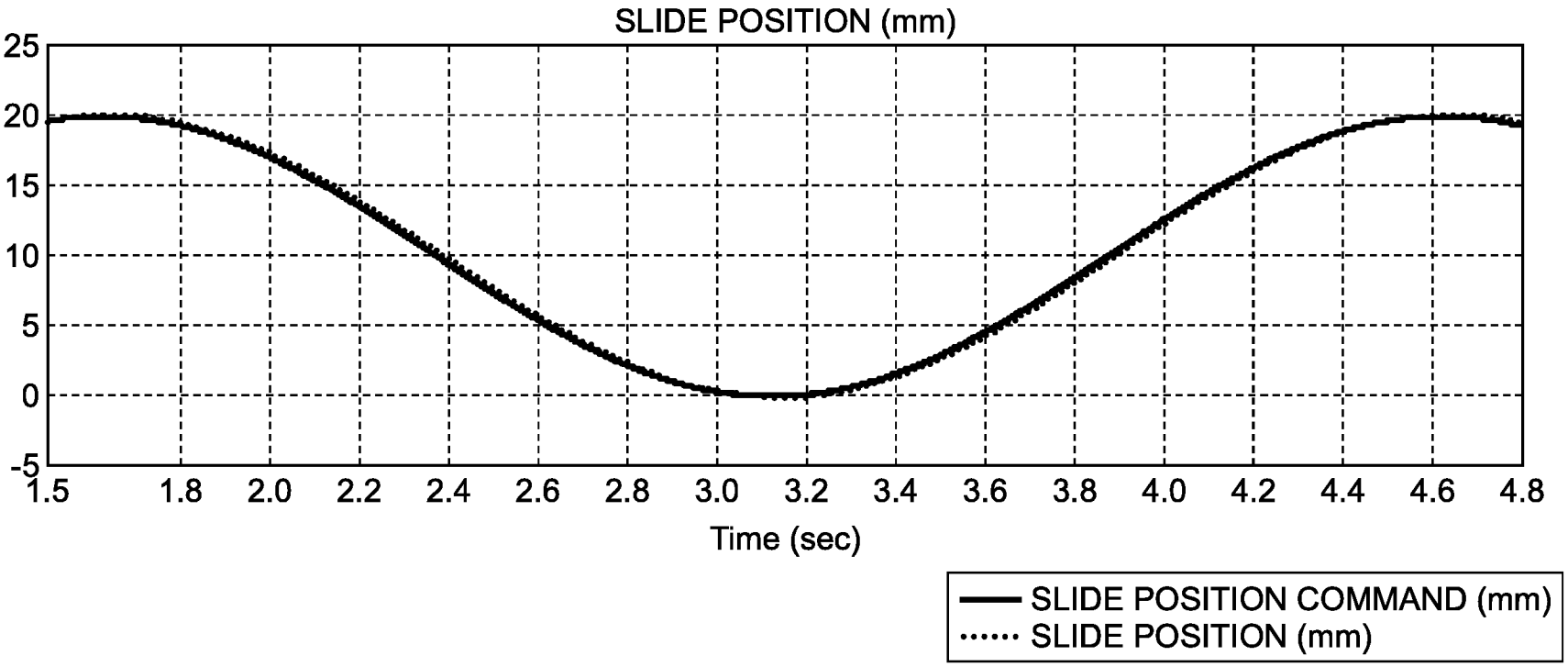
FIG. 3 is a waveform diagram illustrating a slide position command signal and a slide position signal versus elapsed time in a case where the press machine is operated to make the slide position follow the sinusoidal slide position command signal under the condition that a stroke amount and the number of strokes of a slide are 20 mm and 20 SPM, respectively, with no load.

FIG. 3 is a waveform diagram illustrating a slide position command signal and a slide position signal, versus elapsed time in a case where the press machine is operated so as to cause the slide position to follow the sinusoidal slide position command signal under the condition that the stroke amount and the number of strokes of a slide are 20 mm and 20 SPM, respectively, with no load.

According to the first experimental result illustrated in FIG. 3, the (feedforward) compensation amount proportional to the differential value of the slide position command signal was applied (added) to the torque command signal of the respective servomotors, so that the phase delay was hardly generated between the slide position command signal and the slide position signal.

At this stage, the constants $T_{\omega a}$ and $T_{\omega b}$ of the phase lead compensation element 164 were $T_{\omega a}$=0.1, $T_{\omega b}$=0.1, respectively, and the phase lead compensation was not made.

<Second Experimental Result>

Figure 4:
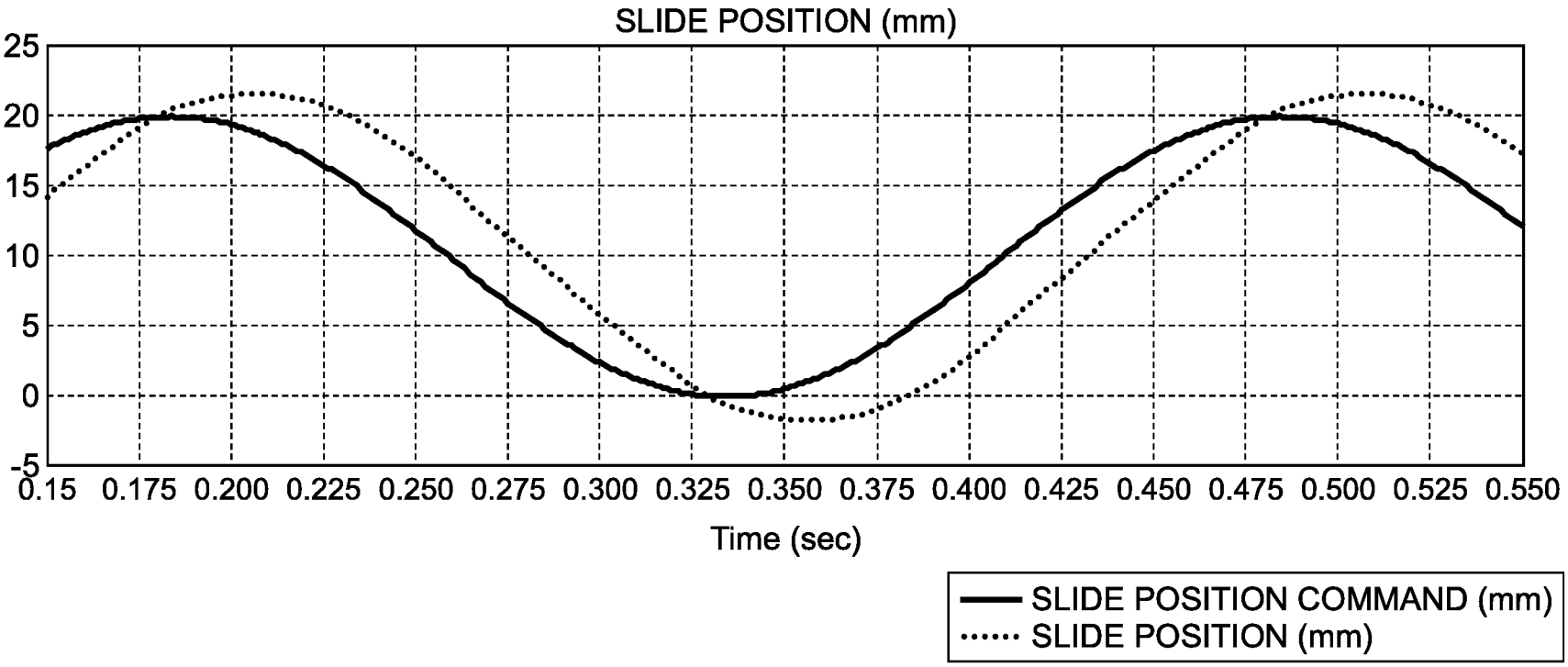
FIG. 4 is a waveform diagram illustrating a slide position command signal and a slide position signal versus the elapsed time in a case where the press machine is operated to make the slide position follow the sinusoidal slide position command signal under the condition that the stroke amount and the number of strokes of a slide are 20 mm and 200 SPM, respectively, with no load.

FIG. 4 is a waveform diagram illustrating a slide position command signal and a slide position signal, versus the elapsed time in a case where the press machine is operated so as to cause the slide position to follow the sinusoidal slide position command signal under the condition that the stroke amount and the number of strokes of a slide are 20 mm and 200 SPM, respectively, with no load.

In the second experiment, the number of strokes of the first experiment (20 SPM) was increased to 10 times (200 SPM).

According to the second experimental result illustrated in FIG. 4, a delay of approximately 26 degrees occurred between the slide position command signal and the slide position (signal) along with increase in the number of strokes (SPM).

This is because a behavior from the slide position command signal to the slide position signal in the slide position control system depends on the frequency characteristics. Nevertheless, the reason why the stroke of the slide position signal with respect to the slide position command signal was amplified (originally should be attenuated), was considered to be mainly because the 200 SPM was present in the vicinity of the natural frequency of the main slide position control system.

This may cause the actual stroke amount to be larger than the set stroke amount (the set stroke amount cannot be achieved). Therefore, for example, adjustment to offset the slide position command signal is required in order to align the bottom dead center of the slide 20, which may deteriorate the usability.

However, the slide position signal responded (clearly) approximately linearly to the slide position command signal.

<Third Experimental Result>

Figure 5:
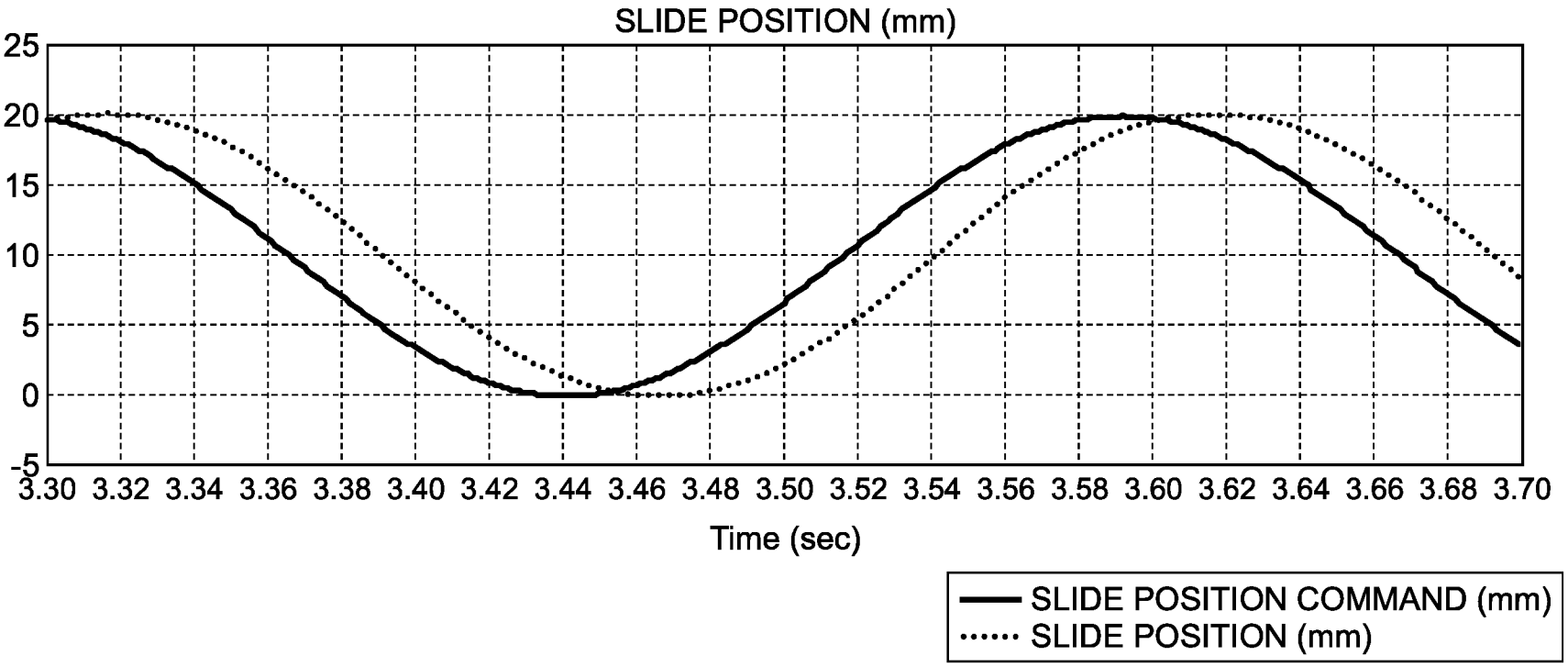
FIG. 5 is a waveform diagram illustrating a slide position command signal and a slide position signal versus the elapsed time in a case where the press machine is operated to make the slide position follow the sinusoidal slide position command signal under the condition that the stroke amount and the number of strokes of a slide are 20 mm and 200 SPM, respectively, with no load, and a case where a variable proportionality constant Khv of a second proportional element of a feedforward compensator is set to Khv=0.81.

FIG. 5 is a waveform diagram illustrating a slide position command signal and a slide position signal, versus the elapsed time in a case where the press machine is operated so as to cause the slide position to follow the sinusoidal slide position command signal under the condition that the stroke amount and the number of strokes of a slide are 20 mm and 200 SPM, respectively, with no load, and a case where a variable proportionality constant Khv of the second proportional element 168 of the feedforward compensator 160 is set to Khv=0.81.

In the third experiment, the variable proportionality constant Khv of the second proportional element 168 was changed from 1 to 0.81 as compared with the second experiment.

According to the third experimental result illustrated in FIG. 5, the variable proportionality constant Khv of the second proportional element 168 was changed from 1 to 0.81, and the amplitude of the compensation amount from the feedforward compensator 160 to be applied to the torque command signals of the respective servomotors was adjusted, so that the actual stroke amount became equal to the set stroke amount.

<Fourth Experimental Result>

Figure 6:
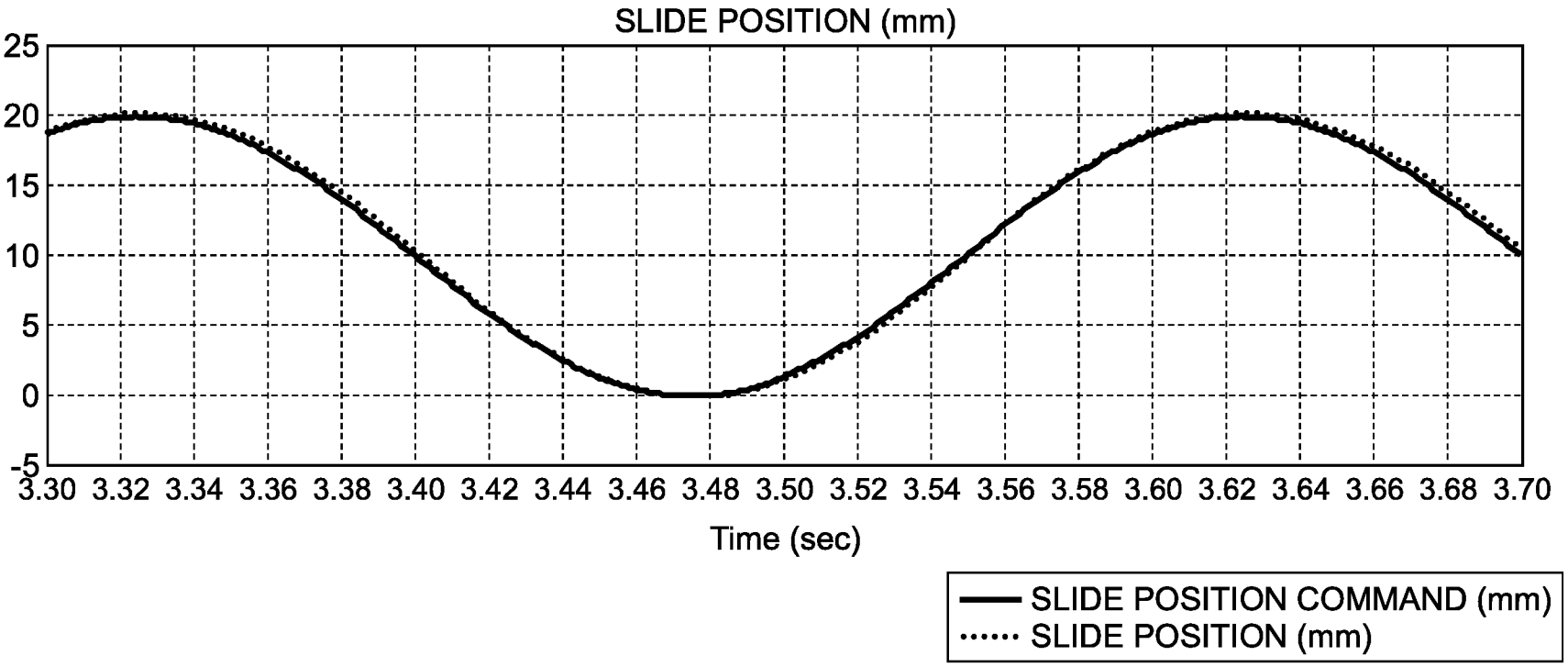
FIG. 6 is a waveform diagram illustrating a slide position command signal and a slide position signal versus the elapsed time in a case where the press machine is operated to make the slide position follow the sinusoidal slide position command signal under the condition that the stroke amount and the number of strokes of a slide are 20 mm and 200 SPM, respectively, with no load, and a case where constants $T_{\omega a}$ and $T_{\omega b}$ of the phase lead compensation element of the feedforward compensator are set to $T_{\omega a}$=0.0296 and $T_{\omega b}$=0.0769, and the variable proportionality constant Khv of the second proportional element is set to Khv=0.608.

FIG. 6 is a waveform diagram illustrating a slide position command signal and a slide position signal, versus the elapsed time in a case where the press machine is operated so as to cause the slide position to follow the sinusoidal slide position command signal under the condition that the stroke amount and the number of strokes of a slide are 20 mm and 200 SPM, respectively, with no load, and a case where constants $T_{\omega a}$ and $T_{\omega b}$ of the phase lead compensation element 164 of the feedforward compensator 160 are set to $T_{\omega a}$=0.0296 and $T_{\omega b}$=0.0769, and the variable proportionality constant Khv of the second proportional element 168 is set to Khv=0.608.

In the fourth experiment, as compared with the second experiment, the constants $T_{\omega a}$ and $T_{\omega b}$ of the phase lead compensation element 164 were changed from $T_{\omega a}$=0.1 and $T_{\omega b}$=0.1 to $T_{\omega a}$=0.0296 and $T_{\omega b}$=0.0769, respectively, and the variable proportionality constant Khv of the second proportional element 168 was changed from 1 to 0.608.

According to the fourth experimental result illustrated in FIG. 6, the constants $T_{\omega a}$ and $T_{\omega b}$ of the phase lead compensation element 164 were respectively set to the constants $T_{\omega a}$=0.0296 and $T_{\omega b}$=0.0769 to cause phase lead by 26.35 degrees, and the variable proportionality constant Khv of the second proportional element 168 was set to 0.608. Thereby, the phase delay from the slide position command signal to the slide position (signal) and the changes in the gain (magnification) were almost eliminated.

Thereby, the slide position (signal) can be made follow the high SPM slide position command signal with high accuracy, and it becomes easier to make the press machine 1 cooperate with a peripheral device for conveying materials or products.

<Fifth Experimental Result>

Figure 7:
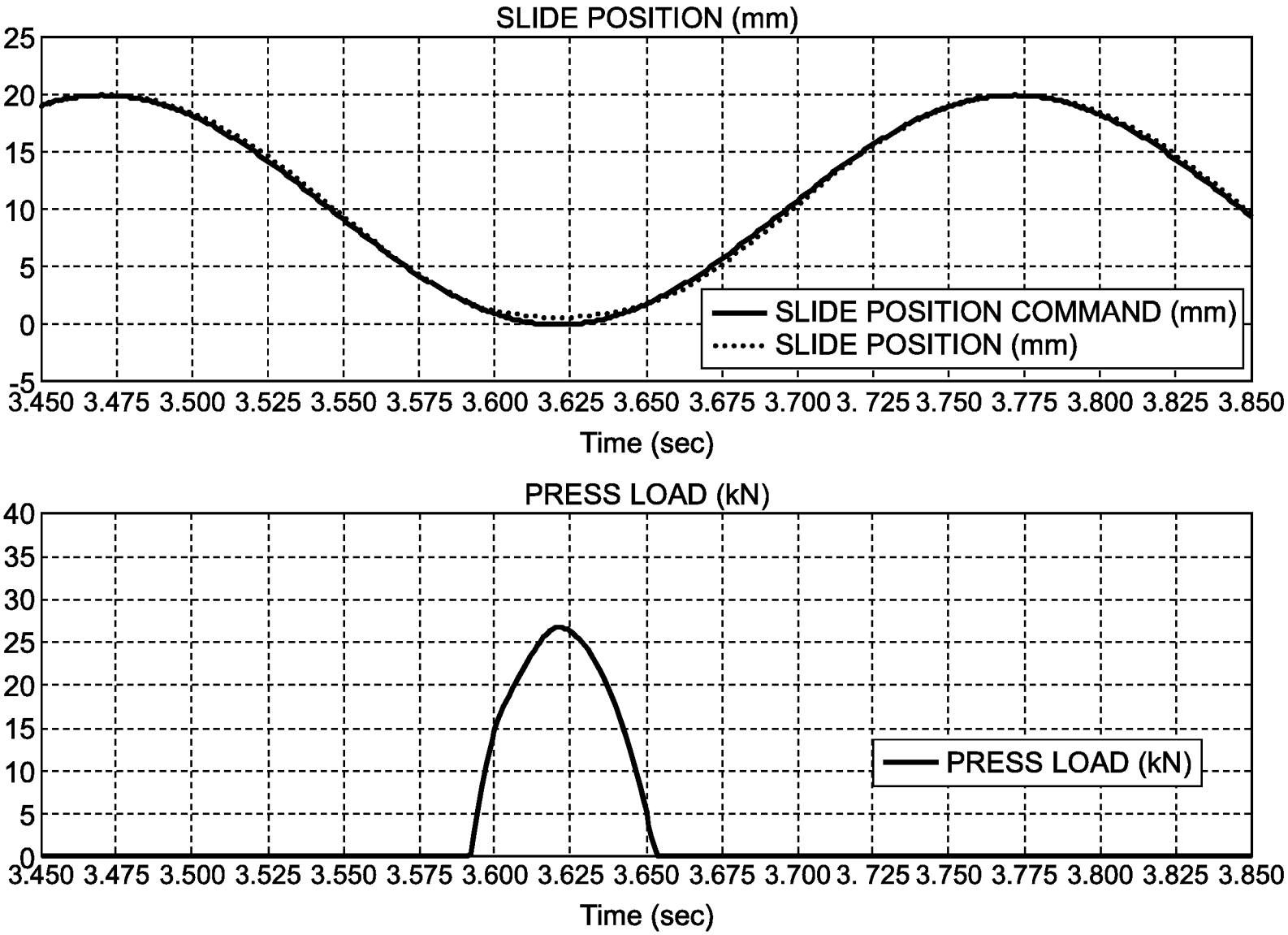
FIG. 7 is a pair of waveform diagrams illustrating a slide position command signal, a slide position signal, and a press load versus the elapsed time in a case where the press machine is operated to make the slide position follow the sinusoidal slide position command signal under the condition that the stroke amount and the number of strokes of a slide are 20 mm and 200 SPM, respectively, with 10% load of the maximum pressurizing capability, and a case where constants $T_{\omega a}$ and $T_{\omega b}$ of the phase lead compensation element of the feedforward compensator are set to $T_{\omega a}$=0.0296 and $T_{\omega b}$=0.0769, and the variable proportionality constant Khv of the second proportional element is set to Khv=0.608.

FIG. 7 is a pair of waveform diagrams illustrating a slide position command signal, a slide position signal and a press load, versus the elapsed time in a case where the press machine is operated so as to cause the slide position to follow the sinusoidal slide position command signal under the condition that the stroke amount and the number of strokes of a slide are 20 mm and 200 SPM, respectively, with 10% load of the maximum pressurizing capability, and a case where constants $T_{\omega a}$ and $T_{\omega b}$ of the phase lead compensation element 164 of the feedforward compensator 160 are set to $T_{\omega a}$=0.0296 and $T_{\omega b}$=0.0769, and the variable proportionality constant Khv of the second proportional element 168 is set to Khv=0.608.

In the fifth experiment, the load operation was changed from the no load operation to the 10% load operation as compared with the fourth experiment. Since the maximum pressurization capacity was 400 kN, the 10% load was 40 kN.

According to the waveform diagram illustrating the press load of FIG. 7, the press load acted so as to (be expected to) reach the maximum of 40 kN at a position from 2 mm above the bottom dead center (10% of the stroke) to the bottom dead center.

Further, according to the fifth experiment result illustrated in FIG. 7, the slide position did not reach the bottom dead center (0 mm), and the press load also fell below the assumed value (40 kN), and the slide 20 turned up at the slide position of about 0.7 mm.

The reason of this behavior was that even though a measure of control compensation was taken by the disturbance compensator or the like in order to improve the slide position control accuracy against the load, since the operation was continued without halting the slide position command signal (without stopping the slide position) at the bottom dead center, the response time for settling the slide to the bottom dead center 0 was insufficient, and the control compensation was not successfully achieved.

<Sixth Experimental Result>

Figure 8:
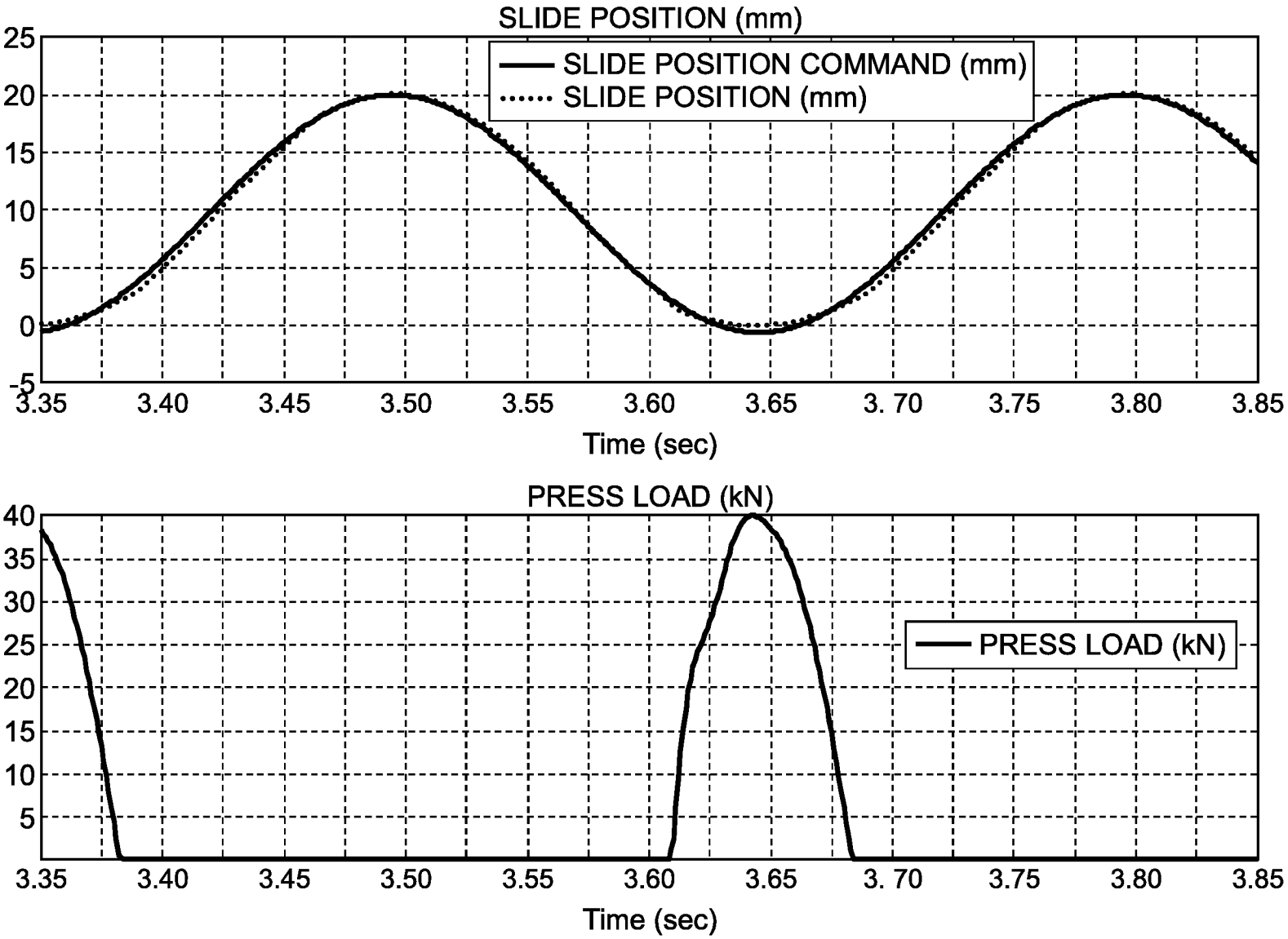
FIG. 8 is a pair of waveform diagrams illustrating a slide position command signal, a slide position signal, and a press load versus the elapsed time when the slide position command signal of the bottom dead center is corrected in a case where the press machine is operated under the same condition as in the fifth experiment.

FIG. 8 is a pair of waveform diagrams illustrating a slide position command signal, a slide position signal and a press load, versus the elapsed time when the slide position command signal of the bottom dead center is corrected in a case where operation is performed under the same condition as in the fifth experiment.

In the sixth experiment, the bottom dead center of the slide position command signal was changed from 0 to −0.57 mm as compared with the fifth experiment.

According to the sixth experimental result illustrated in FIG. 8, the slide position reached a bottom dead center of 0 mm, and the press load also reached the assumed 40 kN at the bottom dead center. This was because the slide position command signal was corrected (offset) in consideration of the amount of slide position deviation (0—slide position signal) at the bottom dead center, which might be caused by the press load acting in the vicinity of the bottom dead center and reaching the peak at the bottom dead center.

The offset amount can be obtained by manual adjustment operation or automatic learning (bottom dead center position automatic correction) operation.

In the present example, the number of strokes (SPM) and the stroke amount of the slide were set first, and then, the adjustment operation was performed during actual forming, and the bottom dead center position command value (−0.57 mm) that satisfied the product accuracy was determined. After that, the bottom dead center position automatic correcting function was enabled, and the production operation was started. The production operation using a die was performed continuously for about 1 hours. The waveform diagrams illustrated in FIG. 8 were measured at this time.

During the production operation, the die is subjected to a temperature change in association with forming and is linearly expanded. Consequently, the press load required for forming also slightly varies. When the press load varies, the bottom dead center of the press machine varies as well, and the product accuracy deteriorates. The bottom dead center position automatic correcting function corrects the slide position command signal by considering the amount of slide position deviation for every cycle in order to suppress the variations of the bottom dead center associated with the press load variation as described above.

The repeatability of the slide position (the press bottom dead center) determined in this manner was maintained at about ±10 μm by the action of the control compensation.

Note that the press machine 1 according to the first embodiment is not limited to the number of strokes, the stroke amounts of the slide, and the like in the first experiment to the sixth experiment described above, and can operate under various conditions. In this case, it is preferable that the constants $T_{\omega a}$ and $T_{\omega b}$ of the phase lead compensation element 164 of the feedforward compensator 160 are set or the variable proportionality constant Khv of the second proportional element 168 of the feedforward compensator 160 is set in accordance with the set number of strokes and the set stroke amount of the slide.

Figure 9:
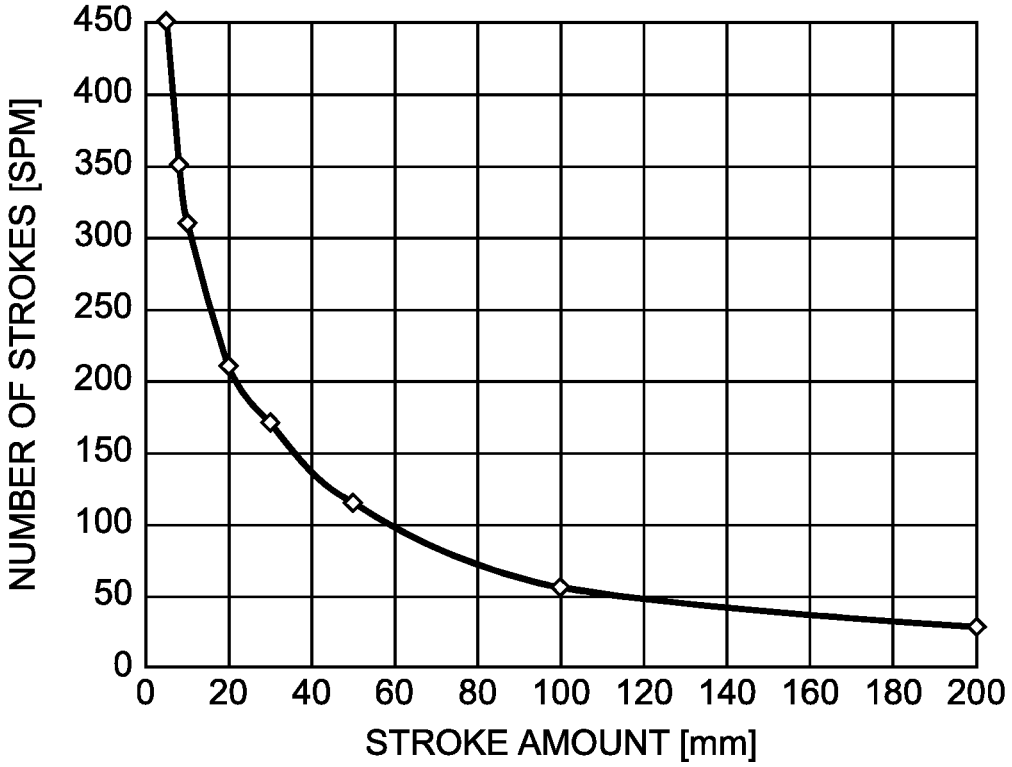
FIG. 9 is a graph illustrating a relationship between the stroke amount and the number of strokes (SPM) of a slide controllable by the press machine according to the first embodiment.

FIG. 9 is a graph illustrating a relationship between the stroke amount and the number of strokes (SPM) of a slide controllable by the press machine 1 according to the first embodiment.

As illustrated in FIG. 9, as the stroke amount of the slide is smaller, the higher SPM can be achieved. When a relatively thin part is produced at a high SPM equal to or more than 100 SPM, the stroke amount of the slide may be set to equal to or less than 50 mm.

Figure 10:
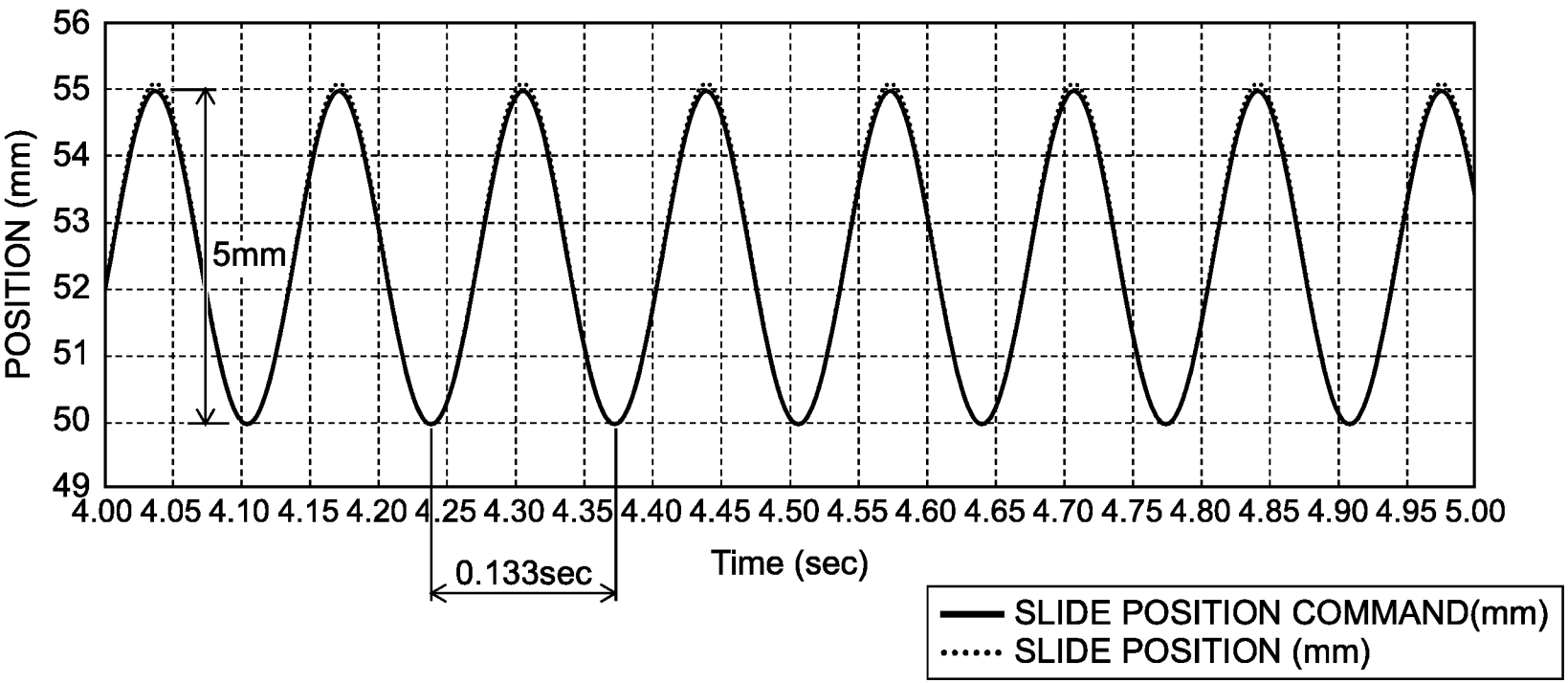
FIG. 10 is a waveform diagram illustrating a slide position command signal and a slide position in a case where the press machine is operated under the condition that the stroke amount and the number of strokes of a slide are 5 mm and 450 SPM, respectively, with no load.

FIG. 10 is a waveform diagram illustrating a slide position command signal and a slide position in the case where the press machine 1 is operated under the condition that the stroke amount and the number of strokes of a slide are 5 mm and 450 SPM, respectively, with no load.

As illustrated in FIG. 10, it can be seen that the slide position follows the slide position command. Note that the stroke amount (5 mm) and the number of strokes (450 SPM) of the slide correspond to the left end of the graph illustrated in FIG. 9.

[Second Embodiment]

Figure 11:
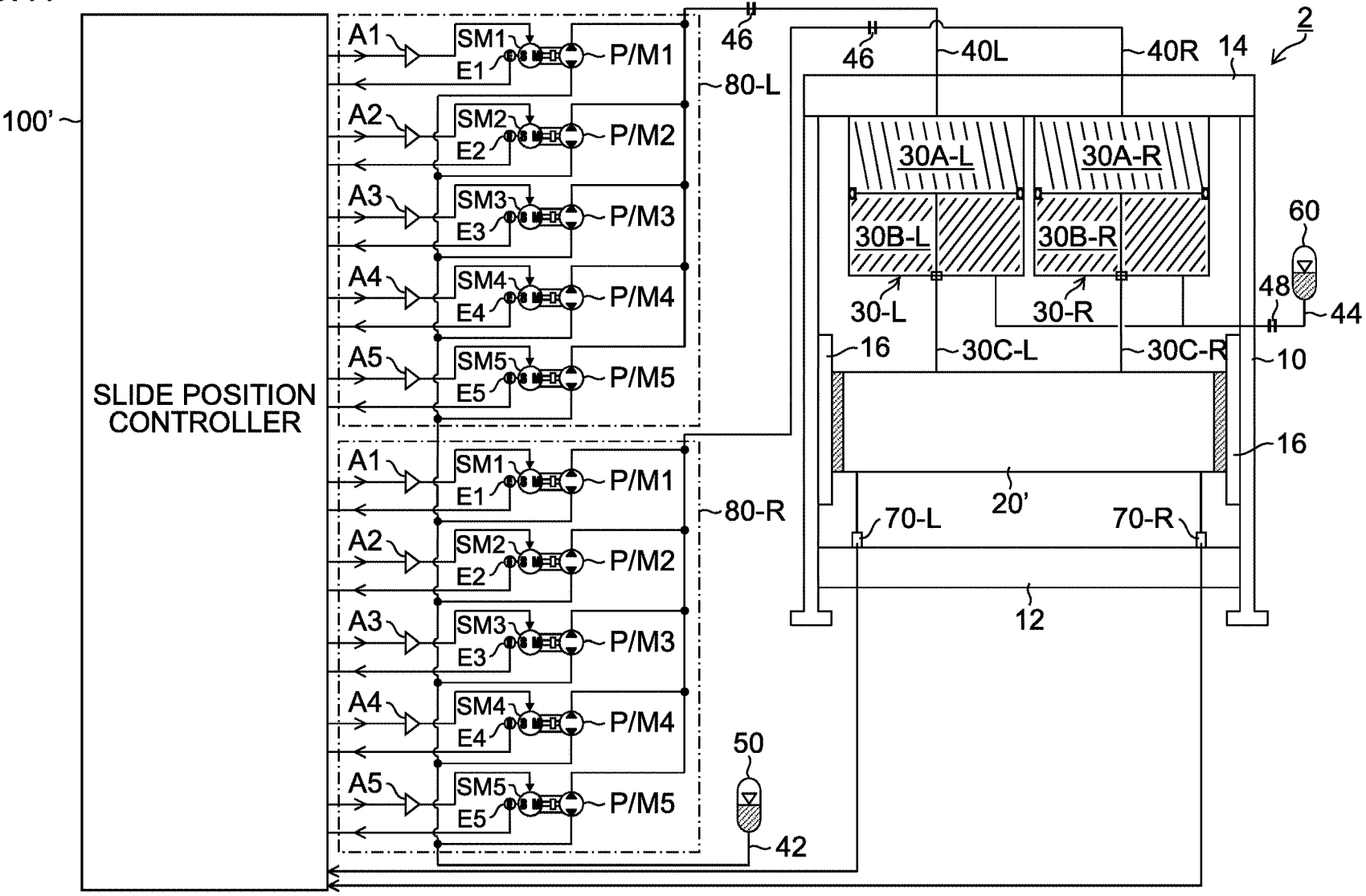
FIG. 11 is a drawing illustrating a second embodiment of a press machine according to the present invention.

FIG. 11 is a drawing illustrating a second embodiment of a press machine according to the present invention. Note that parts in FIG. 11 common to the press machine 1 according to the first embodiment illustrated in FIG. 1 are designated by the same reference numerals, and a detailed description of these common parts will be omitted.

A press machine 2 of the second embodiment illustrated in FIG. 11 includes a plurality of (two) hydraulic cylinders (30-L, 30-R) for driving a single slide 20'. The plurality of hydraulic cylinders (30-L, 30-R) are arranged in parallel to each other.

As hydraulic devices for driving the two hydraulic cylinders (30-L, 30-R), two hydraulic devices represented by dot-dash lines (80-L, 80-R) are provided, respectively. Similar to the press machine 1 according to the first embodiment, each hydraulic device includes five hydraulic pumps/motors (P/M1 to P/M5), five servomotors (SM1 to SM5), and the like.

One of ports of each of the five hydraulic pumps/motors (P/M1 to P/M5) inside the dot-dash line (80-L) is connected to the pressurizing chamber (30A-L) side of the hydraulic cylinder (30-L) through the pipe 40L, and one of ports of each of the five hydraulic pumps/motors (P/M1 to P/M5) inside the dot-dash line (80-R) is connected to the pressurizing chamber (30A-R) side of the hydraulic cylinder (30-R) through the pipe 40R, respectively.

The other port of each of the 2×5 hydraulic pumps/motors (P/M1 to P/M5) inside the dot-dash lines (80-L, 80-R) is connected to the low-pressure accumulator 50 through the pipe 42.

Further, the pressurizing chambers (30B-L, 30B-R) of the hydraulic cylinders (30-L, 30-R) are each connected to the high-pressure accumulator 60 through a pipe 44.

In addition, two slide position detectors (70-L and 70-R) for detecting the position of the slide 20' are installed on the bed 12. The two slide position detectors (70-L, 70-R) of the second embodiment detect the left and right positions of the slide 20', respectively, and output slide position signals indicating the detected left and right positions of the slide 20', respectively, to the slide position controller 100'.

The slide position controller 100' controls the 2×5 servomotors (SM1 to SM5) so that the left and right positions of the slide 20' take positions corresponding to the slide position command signals, respectively, based on a slide position command signal input from the single slide position commander 110 (FIG. 2) and two slide position signals input from the two slide position detectors (70-L, 70-R) and outputs the torque command signals of the 2×5 servomotors (SM1 to SM5) calculated based on the single slide position command signal, the two slide position signals, and the like to the amplifiers (A1 to A5) of the 2×5 servomotors (SM1 to SM5), respectively.

Note that the slide position controller 100' is configured similarly to the slide position controller 100 of the press machine 1 according to the first embodiment illustrated in FIG. 2, and the number of slide position controllers 100 is one, but two systems each including the position controller 120, the stabilization controller 130, the feedforward compensator 160, and the like are provided for each controlling the 2×5 servomotors (SM1 to SM5).

According to the press machine 2 of the second embodiment, even when the slide 20' has a large size and mass, the high SPM operation can be achieved while maintaining the slide 20' horizontally.

[Others]

In the present embodiments, five servomotors+hydraulic pumps/motors are used in parallel for the single hydraulic cylinder; however, the present invention is not limited thereto, and two or more arbitrary number of the servomotors+hydraulic pumps/motors may be provided.

In the second embodiment, the slide 20' is driven by the two hydraulic cylinders (30-L, 30-R). However, the number of hydraulic cylinders is not limited thereto, and may be driven by, for example, four hydraulic cylinders.

In the above embodiments, the slide position command signal which is output from the slide position commander changes the slide position to form a sinusoidal curve with respect to the elapsed time, in a case where the slide position command signal is expressed by a curve with the horizontal axis representing the elapsed time and the vertical axis representing the slide position which is a height of the slide from the bottom dead center. However, the shape of the slide position command signal with respect to the elapsed time is not limited to this example. The slide position command signal may be a one which changes the slide position to form a crank curve with respect to the elapsed time. Here, the change of the slide position to form the crank curve means change of the slide position with respect to the elapsed time in a case where the slide is linearly reciprocated by a crank mechanism. In brief, the slide position command signal may be a signal in which the time differential signal continues smoothly.

Further, the feedforward compensator 160 of the present embodiments includes the differential element 162, the phase lead compensation element 164 and the proportional element (the first proportional element 166 and the second proportional element 168), but the element is not limited thereto. The feedforward compensator 160 may be any means so long as it compensates for the phase delay amount of the slide position (signal) with respect to the slide position command signal. Further, the compensation of the phase delay amount due to the feedforward compensation is not limited to a case where the phase delay amount is substantially zero.

Further, a case where oil is used as the working fluid for the hydraulic cylinder that drives the slide and the hydraulic pumps/motors has been described. However, the present invention is not limited thereto, and water and other liquid are also applicable.

In addition, it is needless to say that the present invention is not limited to the embodiments described above, and various modifications may be made without departing the spirit of the present invention.

What is claimed is:

1. A press machine comprising:

a hydraulic cylinder configured to reciprocate a slide between a top dead center and a bottom dead center of the slide;

a plurality of hydraulic pumps/motors configured to rotate in forward and reverse directions so as to supply a working fluid to the hydraulic cylinder or suck the working fluid from the hydraulic cylinder, the plurality of hydraulic pumps/motors each including a first port connected to a first pressurizing chamber of the hydraulic cylinder that drives the slide in a forward direction;

a plurality of servomotors axially connected to rotating shafts of the plurality of hydraulic pumps/motors respectively;

a first pressure source having a constant pressure equal to or higher than 0.3 MPa and connected to each of second ports of the plurality of hydraulic pumps/motors;

a second pressure source having a constant pressure equal to or higher than 1 MPa and connected to a second pressurizing chamber of the hydraulic cylinder that drives the slide in a reverse direction;

a slide position commander configured to output a slide position command signal for the slide;

a slide position detector configured to detect a position of the slide and output a slide position signal; and a slide position controller configured to control the plurality of servomotors so that the position of the slide matches a position corresponding to the slide position command signal based on the slide position command signal and the slide position signal wherein each moment of inertia of a single hydraulic pump/motor and a servomotor among the plurality of hydraulic pumps/motors and the plurality of servomotors axially connected thereto is equal to or less than 1 $kgm^2$.

2. The press machine according to claim 1, wherein the slide position command signal output from the slide position commander has a continuous time differential signal.

3. The press machine according to claim 1, wherein the slide position command signal output from the slide position commander changes to form a sinusoidal curve or a crank curve.

4. The press machine according to claim 1, wherein the slide position commander outputs the slide position command signal which makes a number of strokes per minute of the slide to be equal to or more than 100.

5. The press machine according to claim 1, wherein the slide position commander outputs the slide position command signal which causes a stroke amount from a top dead center to a bottom dead center of the slide to be equal to or less than 50 mm.

6. The press machine according to claim 1, further comprising a plurality of angular velocity detectors configured to each detect rotational angular velocities of the plurality of servomotors, wherein the slide position controller includes a stabilization controller configured to use angular velocity signals respectively detected by the plurality of angular velocity detectors, as angular velocity feedback signals.

7. The press machine according to claim 1, wherein the slide position controller includes a feedforward compensator that receives the slide position command signal as an input signal, and causes a feedforward compensation amount calculated by the feedforward compensator to act on a torque command signal of the plurality of servomotors calculated based on the slide position command signal and the slide position signal.

8. The press machine according to claim 7, wherein the feedforward compensator calculates the feedforward compensation amount by a phase lead compensation element.

9. The press machine according to claim 8, wherein the phase lead compensation element is represented by $(1+T_{\omega b}\cdot s)/(1+T_{\omega a}\cdot s)$, where s is a Laplace operator, $T_{\omega a}$ and $T_{\omega b}$ are constants, and the constants $T_{\omega a}$ and $T_{\omega b}$ are set in accordance with a number of strokes per minute of the slide and a stroke amount from a top dead center to a bottom dead center of the slide.

10. The press machine according to claim 7, wherein the feedforward compensator calculates the feedforward compensation amount by a differential element and a proportional element.

11. The press machine according to claim 1, wherein a plurality of the hydraulic cylinders configured to drive the slide are arranged in parallel, and the plurality of hydraulic pumps/motors and the plurality of servomotors are provided for each of the hydraulic cylinders.

12. A press machine comprising:

a hydraulic cylinder configured to reciprocate a slide between a top dead center and a bottom dead center of the slide;

a plurality of hydraulic pumps/motors configured to rotate in forward and reverse directions so as to supply a working fluid to the hydraulic cylinder or suck the working fluid from the hydraulic cylinder, the plurality of hydraulic pumps/motors each including a first port connected to a first pressurizing chamber of the hydraulic cylinder that drives the slide in a forward direction;

a plurality of servomotors axially connected to rotating shafts of the plurality of hydraulic pumps/motors respectively;

a first pressure source having a constant pressure equal to or higher than 0.3 MPa and connected to each of second ports of the plurality of hydraulic pumps/motors;

a second pressure source having a constant pressure equal to or higher than 1 MPa and connected to a second pressurizing chamber of the hydraulic cylinder that drives the slide in a reverse direction;

a slide position commander configured to output a slide position command signal for the slide;

a slide position detector configured to detect a position of the slide and output a slide position signal; and a slide position controller configured to control the plurality of servomotors so that the position of the slide matches a position corresponding to the slide position command signal based on the slide position command signal and the slide position signal, wherein the slide position controller includes a feedforward compensator that receives the slide position command signal as an input signal, and causes a feedforward compensation amount calculated by the feedforward compensator to act on a torque command signal of the plurality of servomotors calculated based on the slide position command signal and the slide position signal, and wherein the feedforward compensator calculates the feedforward compensation amount by a differential element and a proportional element.

13. The press machine according to claim 12, wherein the slide position command signal output from the slide position commander has a continuous time differential signal.

14. The press machine according to claim 12, wherein the slide position command signal output from the slide position commander changes to form a sinusoidal curve or a crank curve.

15. The press machine according to claim 12, wherein the slide position commander outputs the slide position command signal which makes a number of strokes per minute of the slide to be equal to or more than 100.

16. The press machine according to claim 12, wherein the slide position commander outputs the slide position command signal which causes a stroke amount from a top dead center to a bottom dead center of the slide to be equal to or less than 50 mm.

17. The press machine according to claim 12, further comprising a plurality of angular velocity detectors configured to each detect rotational angular velocities of the plurality of servomotors, wherein the slide position controller includes a stabilization controller configured to use angular velocity signals respectively detected by the plurality of angular velocity detectors, as angular velocity feedback signals.

18. The press machine according to claim 12, wherein the feedforward compensator calculates the feedforward compensation amount by a phase lead compensation element.

19. The press machine according to claim 18, wherein the phase lead compensation element is represented by $(1+T_{\omega b}\cdot s)/(1+T_{\omega a}\cdot s)$, where s is a Laplace operator, $T_{\omega a}$ and $T_{\omega b}$ are constants, and the constants $T_{\omega a}$ and $T_{\omega b}$ are set in accordance with a number of strokes per minute of the slide and a stroke amount from a top dead center to a bottom dead center of the slide.

20. The press machine according to claim 12, wherein a plurality of the hydraulic cylinders configured to drive the slide are arranged in parallel, and the plurality of hydraulic pumps/motors and the plurality of servomotors are provided for each of the hydraulic cylinders.

* * * * *